United States Patent [19]

Dalgleish

[11] 3,981,395

[45] Sept. 21, 1976

[54] CONTAINER FOR COINS AND SIMILAR DISC SHAPED MEMBERS

[76] Inventor: Jack Frank Dalgleish, 1401 Prince of Wales Drive, Apt. 1505, Ottawa, Ontario, Canada, K2C 3J8

[22] Filed: May 7, 1975

[21] Appl. No.: 575,164

[52] U.S. Cl. ..... 206/.82; 206/.83; 206/445

[51] Int. Cl.[2] ..... A45C 11/00; B65D 85/58

[58] Field of Search ..... 206/.82, .83, 445, 535; 150/42, 46

[56] References Cited

UNITED STATES PATENTS

| | | | |
|---|---|---|---|
| 574,546 | 1/1897 | Lawlor | 206/.82 |
| 851,078 | 4/1907 | Dunn | 206/.83 |
| 1,512,549 | 10/1924 | Labadie et al. | 206/.82 |
| 3,420,359 | 1/1969 | Cochrane | 206/.82 |
| 3,473,590 | 10/1969 | Rohlik | 150/46 X |

FOREIGN PATENTS OR APPLICATIONS

| | | | |
|---|---|---|---|
| 1,363,315 | 5/1964 | France | 206/.82 |

*Primary Examiner*—Leonard Summer

[57] ABSTRACT

A container for coins and similar objects has two spaced apart circular end members joined by a cylindrical wall, the wall connected with the end members for only part of the circumference and forming at least one flap for closing the container, the cooperating edges of the flap and wall having interengaging formations for retaining the flap in a closed position. The container is conveniently molded in plastic material and several containers can be molded as one unit, with each container holding the same size objects, or different containers for different size objects.

4 Claims, 9 Drawing Figures

CONTAINER FOR COINS AND SIMILAR DISC SHAPED MEMBERS

This invention relates to containers for coins and similar disc shaped members, and in particular to reusable containers for holding a predetermined number of coins of a particular denomination.

At present coins are supplied to stores, bank tellers and other users, rolled in paper tubes. The opening of such tubes is sometimes difficult and care has to be taken that no coins remain in the roll after opening. Special apparatus has to be used to wrap the coins. Hand wrapping of coins in paper rolls requires counting of coins to ensure correct number of coins in each roll.

The present invention provides a container of a molded plastic material having closed ends and a wall which opens for the full length of the container. The wall can be readily closed and retained in the closed condition by interengaging formations on engaging edges. The size of the container can be varied to accommodate different denominations of coins, or different sizes of other disc shaped members and a container can be of multiple form to hold several "rolls" of coins, of the same or differing denominations. Containers are reusable and avoid the need for coin counting.

The invention will be readily understood by the following description of certain embodiments, by way of example, in conjunction with the accompanying drawings, in which.

Figures 1, 2, 3, 4, 5, 6, 7, 8, 9:
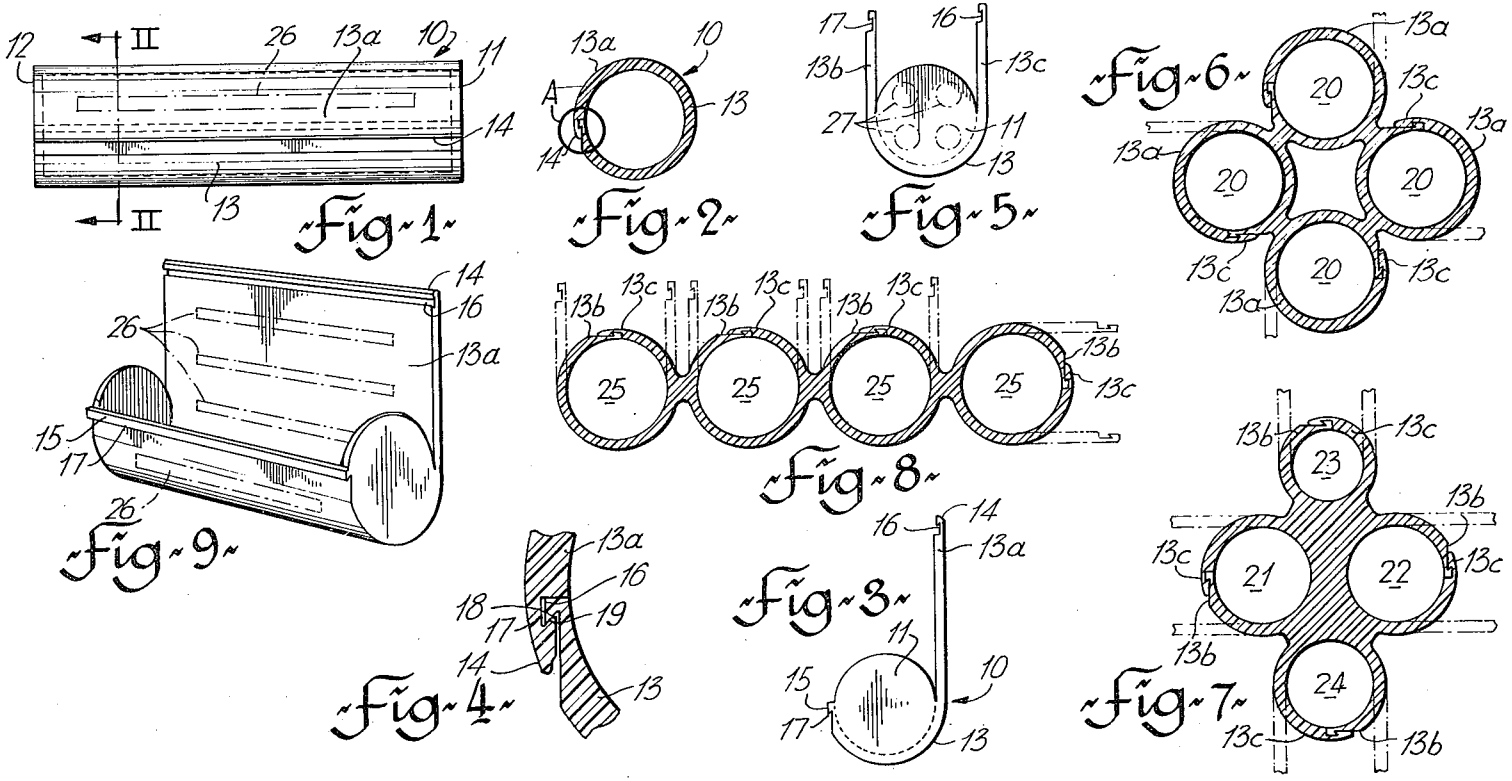
FIG. 1 is a side view of a container.
FIG. 2 is a cross-section on the line II—II of FIG. 1.
FIG. 3 is an end view of the container of FIG. 1 in an opened condition.
FIG. 4 is a view of the portion within circle A in FIG. 2, to an enlarged scale.
FIG. 5 is a similar view to that of FIG. 3 illustrating an alternative arrangement.
FIGS. 6, 7 and 8 are cross-sections through alternate forms of multiple unit containers.
FIG. 9 is a perspective view of a container as in FIG. 3.

FIGS. 1, 2 and 3 illustrate a general form of container 10 in accordance with the present invention. The container 10 is molded from a flexible plastic material having circular end members 11 and 12 and a wall 13 uniting the ends 11 and 12. In the form illustrated in FIGS. 1, 2 and 3, the wall 13 is permanently attached to, and molded unitarily with, the ends for approximately half the circumference of the ends. The remainder of the wall forms a flap designated 13*a*, and is not attached to the ends but can be wrapped round, as illustrated in FIG. 2, to form in a closed condition, a cylindrical enclosure. In an open condition, as illustrated in FIG. 3, the flap or portion 13*a* extends tangentially to the circular ends.

The longitudinal edge 14 of the flap 13*a* cooperates with the edge 15 of the wall 13. Complimentary hooked shaped formations 16 and 17 are formed along the edges 14 and 15 respectively. These are seen in more detail in FIG. 4. As the flap 13*a* is wrapped over the coins in a container, the two edges 14 and 15 are moved into engagement. With a slight pressure the hook shaped formation 16 is pushed into interengagement with the hook shaped formation 17, with slight distortion of the shapes occurring as the formations are pushed into interengagement. As will be seen each formation is undercut, at 18, and the edges 19 fit into the undercut 18. Thus once in engagement the formations hold firmly against accidental opening of the container. However the container is readily opened, by inserting a finger nail under the formation 17 for example.

In use, with the flap 13*a* in the open position, as in FIG. 3, coins are placed in the container. The dimensions of the container are suited to the coin, that is diameter and number of coins to be held. After filling with coins the flap is wrapped round and the edges 14 and 15 pressed firmly together to engage the formations 16 and 17.

In an alternative arrangement, as illustrated in FIG. 5, instead of a single long flap 13*a*, as in FIG. 3, two shorter flaps 13*b* and 13*c* can be provided. In other respects a container as in FIG. 5 is the same as in FIGS. 1 to 4. Interengaging formations 16 and 17 are formed as in FIG. 4, on the ends of the flaps 13*b* and 13*c*.

The container illustrated in FIGS. 1 to 4, and the alternate form as in FIG. 5, consists of a single container for one particular coin size or denomination. It is possible to provide containers for holding several sets of coins. The sets can be of the same or of differing denominations.

Thus FIG. 6 illustrates a container having four compartments 20. As an example each compartment is of the form as illustrated in FIG. 3, that is each compartment has a single flap 13*a*, with interengaging formations as in FIG. 4. The compartments are shown closed, and with the open position of the flaps shown in dotted outline. In the example of FIG. 6 each compartment 20 is of the same size.

In FIG. 7 an alternative arrangement of a container having four compartments is illustrated. In this example two compartments 21 and 22 are of the same size for a large coin, compartment 23 is of a small size for a small coin and compartment 24 is of a size intermediate compartments 22 and 23. Depending upon the number of coins to be held, each compartment will possibly vary in length somewhat. This can be obtained by varying the overall length of the individual compartments, or by varying the thickness of the ends, or both. In FIG. 7, each compartment has two flaps 13*b* and 13*c*, as in FIG. 5, with interengaging formations as in FIG. 4.

FIG. 8 illustrates an "in-line" arrangement. In this example all compartments 25 are of the same size but can be of differing sizes. Also, as shown, each compartment has two flaps 13*b* and 13*c*. One of the end compartments is shown with the flaps 13*b* and 13*c* extending parallel to the axis of the container in the open condition. This is an alternative to a lateral extending as for the other compartments and is optional.

The number of compartments can vary and although four compartments are illustrated in FIGS. 6, 7 and 8, two three or more than four can be provided. However, the container becomes bulky, and heavy when filled, with more than four compartments.

The containers can conveniently be made by molding. For example, containers as in FIGS. 1 to 4, FIG. 5, FIG. 7 and FIG. 8 are readily molded. They can be molded with the flaps 13*a*, and 13*b* and 13*c*, in the open or extended condition. Alternatively they can be made from an extrusion. A length of extrusion is cut off and separately formed discs fixed in each end, by adhesive or by some other method. Also two or more moldings, or extrusions, can be assembled together, by adhesive or welding for example.

Particularly when molded, the containers can have slots formed in the wall 13, for example as indicated by chain dotted lines 26 in FIGS. 1 and 3. This enables the ready identification of filled tubes. Slots or apertures can be provided in the ends 11 and 12 as indicated by dotted lines 27 in FIG. 5.

While specifically described in relation to coins, containers in accordance with the present invention can be used for other disc shaped members, such as metal washers, discs used for games, such as poker chips, and the like.

What is claimed is:

1. A container for coins, comprising an integral single piece molded structure having two circular spaced apart end members and a wall joining said end members, said wall extending peripherally for the entire periphery of said end members and integral with said end members for a maximum of half of the periphery of said end members to form a fixed portion integral with said end members and a flexible flap portion, said wall in a closed condition of the container having opposed laterally extending edges, a first integrally molded formation extending along one of said edges and a second integrally molded formation extending along the other of said edges, said first formation including a re-entrant portion extending laterally for the length of said one edge on an outer surface of said wall, said second formation including a projection extending inwardly from said other edge for the length of the wall, said other edge on said flap, said projection adapted to enter into said re-entrant portion with said formations in overlapping relationship, whereby when the container is closed and said formations are interengaged, flexing and stressing of said container urges said formations into continued engagement.

2. A container as claimed in claim 1, including two flaps extending the length of said container each flap including a laterally extending edge, said interengaging formations formed one of each edge.

3. A container for coins comprising an integral single piece molded structure having a plurality of compartments, each compartment having two circular spaced apart end members and a wall joining said end members, said wall extending peripherally for the entire periphery of said end members and integral with said end members for a maximum of half of the periphery of said end members to form a fixed portion integral with said end members and a flexible flap portion, said wall in a closed condition of the container, having opposed laterally extending edges, a first integrally molded formation extending along one of said edges and a second integrally molded formation extending along the other of said edges, said first formation including a re-entrant portion extending laterally for the length of said one edge on an outer surface of said wall, said second formation including a projection extending inwardly from said other edge for the length of the wall, said other edge on said flap, said projection adapted to enter into said re-entrant portion with said formations in overlapping relationship, whereby when the container is closed and said formations are interengaged, flexing and stressing of said container urges said formations into continued engagement.

4. A container as claimed in claim 3 said compartments adapted to receive coins of differing sizes, one size in each compartment.

* * * * *